US012630346B2

(12) United States Patent
Niederreiter et al.

(10) Patent No.: US 12,630,346 B2
(45) Date of Patent: May 19, 2026

(54) MULTI-LAYER FLEXIBLE PACKAGING MATERIAL

(71) Applicant: SOCIETE DES PRODUITS NESTLE S.A., Vevey (CH)

(72) Inventors: Gerhard Niederreiter, Vevey (CH); Nicola Galaffu, Ornex (FR); Marie-Amelie Francoise Suzanne Gleron, Vevey (CH); Colin Gardner Neill, St-Legier (CH); Alexey Vishtal, Lausanne (CH); Abhijit Bhattacharya, Epalinges (CH)

(73) Assignee: Societe des Produits Nestle S.A., Vevey (CH)

( * ) Notice: Subject to any disclaimer, the term of this patent is extended or adjusted under 35 U.S.C. 154(b) by 175 days.

(21) Appl. No.: 18/568,117

(22) PCT Filed: Jun. 10, 2022

(86) PCT No.: PCT/EP2022/065891
§ 371 (c)(1),
(2) Date: Dec. 7, 2023

(87) PCT Pub. No.: WO2022/258830
PCT Pub. Date: Dec. 15, 2022

(65) Prior Publication Data

US 2024/0270465 A1 Aug. 15, 2024

(30) Foreign Application Priority Data

Jun. 11, 2021 (EP) ..... 21178997

(51) Int. Cl.

| | |
|---|---|
| ***B65D 65/42*** | (2006.01) |
| ***D21H 19/08*** | (2006.01) |
| ***D21H 19/40*** | (2006.01) |
| ***D21H 19/82*** | (2006.01) |

(52) U.S. Cl.
CPC ..... *B65D 65/42* (2013.01); *D21H 19/08* (2013.01); *D21H 19/40* (2013.01); *D21H 19/826* (2013.01)

(58) Field of Classification Search
None
See application file for complete search history.

(56) References Cited

U.S. PATENT DOCUMENTS

| | | | | |
|---|---|---|---|---|
| 2011/0223401 | A1* | 9/2011 | Harlin | C23C 16/45555 427/250 |
| 2013/0101831 | A1 | 4/2013 | Knoerzer et al. | |
| 2013/0101855 | A1 | 4/2013 | Cham et al. | |
| 2014/0050934 | A1 | 2/2014 | Siegenthaler et al. | |
| 2020/0122874 | A1 | 4/2020 | Doster et al. | |
| 2021/0107263 | A1 | 4/2021 | Bartolucci et al. | |

FOREIGN PATENT DOCUMENTS

| | | |
|---|---|---|
| CN | 112469862 A | 3/2021 |
| WO | 2009005947 | 1/2009 |

OTHER PUBLICATIONS

Chinese Office Action for Appl No. 202280039549.4 dated Jun. 19, 2025, 8 pages.
Japanese Office Action for Appl No. 2023-574734 dated Nov. 11, 2025, 3 pages.
Bo, "Plastics Modification Technology", China Textile & Apparel Press, 2016, 7 Pages.
Chinese Office Action for Appl No. 202280039549.4 dated Jan. 28, 2026, 9 pages.

* cited by examiner

*Primary Examiner* — Sheeba Ahmed
(74) *Attorney, Agent, or Firm* — K&L Gates LLP

(57) ABSTRACT

The present invention relates generally to the field of multi-layer flexible packaging material. In particularly, the present invention relates to a multi-layer flexible packaging material to package dry food, preferably confectionery. The packaging material of the present invention is marine degradable, recyclable and has acceptable barrier properties.

14 Claims, 3 Drawing Sheets

MULTI-LAYER FLEXIBLE PACKAGING MATERIAL

CROSS REFERENCE TO RELATED APPLICATIONS

The present application is a National Stage of International Application No. PCT/EP2022/065891, filed on Jun. 10, 2022, which claims priority to European Patent Application No. 21178997.9, filed on Jun. 11, 2021, the entire contents of which are being incorporated herein by reference.

FIELD OF THE INVENTION

The present invention relates generally to the field of multi-layer flexible packaging material. In particularly, the present invention relates to a multi-layer flexible packaging material. The present invention further relates to the use of the multi-layer flexible packaging material in accordance with the present invention to package dry food.

BACKGROUND OF THE INVENTION

Plastic packaging is used frequently in the economy and in people's daily lives. It has multiple advantages, such as its flexibility and its light weight. Such a weight reduction contributes to fuel saving and CO2 reduction during transport, for example. Its barrier properties help to reduce food waste due a positive effect on increasing shelf life. The barrier properties also help to secure food safety.

However, according to the European strategy for plastics in a circular economy, recently published by the European Commission, around 25.8 million tons of plastic waste are generated in Europe every year with less than 30% of such waste being collected for recycling and between 150 000 to 500 000 tons of plastic waste entering the oceans every year.

To ensure that plastic waste is reduced, significant efforts are made in the industry and in commerce. Several supermarkets replace plastic bags by paper based bags, for example. However, replacing plastics with paper in food packaging is not an easy task. A change in packaging material must not compromise consumer safety. The packaging must serve to protect the food, but must also be robust enough to be handled by machines during the production process, and must allow that the food product is presented effectively.

Hence, there is a need for paper based materials with improved barrier properties. There is—in particular—a need for paper based materials with improved barrier properties that do not include a plastic layer, to allow for easier sorting and separation of paper-based material during recycling.

WO 2000/076862 describes in this respect a laminate structure for packaging applications comprising a paper substrate; and at least one polymer/nanoclay composite layer having clay particles with a thickness ranging from 0.7 to 9 nanometres applied to said paper substrate.

However, there is a need in the art to even further improve the barrier properties of a paper based packaging material.

In particular, for packaging intended for food products, good barrier properties are essential for maintaining the safety and quality of packaged foods. Typically, such barrier properties include gas permeability, for example O2, CO2, and N2; vapor permeability, for example water vapor; liquid permeability, for example water or oil; aroma permeability; and light permeability.

In addition, against this background of recycling, is the issue of packaging not being appropriately disposed of by the consumer, i.e. littering. Such material may end up in the natural environment and, specifically problematically, in the marine environment. Traditional confectionery packaging is also small, which increases the likelihood of accidental littering and the plastic materials used can take years to disintegrate.

Hence, the present invention seeks to balance the issues of barrier properties, recyclability, and marine degradation Any reference to prior art documents in this specification is not to be considered an admission that such prior art is widely known or forms part of the common general knowledge in the field.

SUMMARY OF THE INVENTION

The objective of the present invention is to improve the state of the art and, in particular, to provide a multi-layer flexible packaging material that provides improved barrier properties and may be recycled and is degradable in marine conditions; and to provide the use of such a multi-layer flexible packaging material to package dry food products, or to at least to provide a useful alternative to packaging solutions existing in the art.

The present inventors have solved the above problems by applying to a paper-based packaging material:

- a polymeric layer comprising at least one polymer and optionally a clay barrier material,
- a barrier layer comprising a metallized material, aluminium oxide or silicon oxide or mixtures thereof, and
- a sealant layer,
- wherein said polymeric layer comprises at least one polymer selected from the group consisting of butenediol-vinyl alcohol copolymer (BVOH), polybutylene succinate (PBS), copolymers of polybutylene succinate, polyhydroxyalkanoate (PHA), polylactic acid (PLA) and mixtures thereof.

The present invention provides water vapor transmission rate (WVTR) and oxygen transmission rate (OTR) test results that satisfied the requirements for the packaging of dry food materials, as well as offering marine degradation and recycling opportunities. Importantly, no polyethylene (PE) or a polypropylene (PP) layer was needed to achieve this objective.

Consequently, the objective of the present invention was achieved by the subject matter of the independent claims. The dependent claims further develop the concept of the present invention.

Accordingly, the present invention provides a multi-layer flexible packaging material comprising a paper layer, an aluminium layer, a nanoclay barrier coating layer, and a sealing layer applied to the surface of the nanoclay barrier coating layer representing the inner surface of the multi-layer flexible packaging material.

The present invention further provides a use of a multi-layer flexible packaging material in accordance with the present invention to package dry food, preferably confectionery, preferably a chocolate product and/or biscuit or wafer product.

As used in this specification, the words "comprises", "comprising", and similar words, are not to be interpreted in an exclusive or exhaustive sense. In other words, they are intended to mean "including, but not limited to".

The present inventors have shown that by using the multi-layer flexible packaging material in accordance with the present invention acceptable results in terms of WVTR and OTR could be achieved. Additionally, as displayed in the figures, the present invention offers advantageous properties in respect of marine degradation.

DETAILED DESCRIPTION OF THE INVENTION

Figure 1:
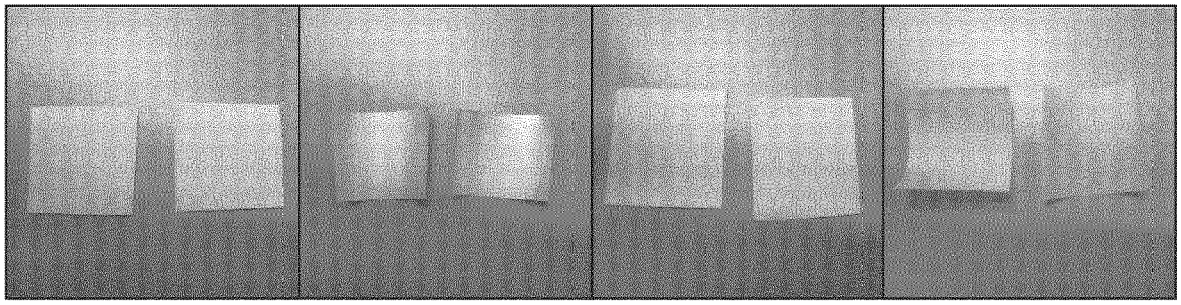
FIG. 1. Visual presentation of reference material cellulose, 2020-31, 2020-32 and 2020-33 (from left to right)

The present invention relates to a multi-layer flexible packaging material comprising the following layers from the outer surface to the inner surface:

- a paper layer,
- a polymeric layer comprising at least one polymer and optionally a clay barrier material,
- a barrier layer comprising a metallized material, aluminium oxide or silicon oxide or mixtures thereof, and
- a sealant layer,
- wherein said polymeric layer comprises at least one polymer selected from the group consisting of butenediol-vinyl alcohol copolymer (BVOH), polybutylene succinate (PBS), copolymers of polybutylene succinate, polyhydroxyalkanoate (PHA), polylactic acid (PLA) and mixtures thereof.

In a highly preferred embodiment, said multilayer flexible barrier material being devoid of a polyolefin layer (such as polyethylene (PE), polyethylene terepthalate (PET) or a polypropylene (PP) layer). In a preferred embodiment, the term "devoid" means 0 wt %.

For the purposes of the present invention, a packaging material shall be considered flexible if it is a material capable of bending without breaking. Further, for example, such a flexible material may be a material that can be bent without breaking by hand. Typically, a multi-layer flexible packaging material in accordance with the present invention may have a basis weight of 140 g/m2 or less.

The packaging material of the present invention is paper-based. People skilled in the art will be able to select an appropriate paper layer, for example, based on the product to be packaged, the intended shelf life and whether the paper material is to be used as primary, secondary, or tertiary packaging.

The present invention comprises barrier layer comprising a metallized material, aluminium oxide or silicon oxide or mixtures thereof.

The metallisation layer may be applied to the multi-layer flexible packaging material by physical vapor deposition. For example, the metallisation layer may be applied by means of a vacuum deposition process. An example of a vacuum deposition process is described in Thin Solid Films, Volume 666, 30 Nov. 2018, Pages 6-14. Vacuum deposition is an evaporative process in which a metal from a solid phase is transferred to the vapor phase and back to the solid phase, gradually building up film thickness. Coatings produced by vacuum deposition have the advantage of good abrasion resistance, impact and temperature strength, as well as the capability to be deposited on complex surfaces. In a preferred embodiment, the metallisation deposits aluminium.

In the present invention, the method of deposition of the silicon dioxide film is not limited. Silicon dioxide films can be produced by different methods, such as sol-gel, liquid phase deposition, sputtering, Chemical Vapor Deposition (CVD), thermal oxidation, Plasma Enhanced Chemical Vapor Deposition (PECVD), atmospheric pressure plasma deposition, and Physical Vapor Deposition (PVD). PVD is one of the most established vacuum deposition techniques. It includes vacuum evaporation, ion plating and sputtering deposition. These techniques allow better control of the film thickness and the ensure that the deposited film has a good adhesion performance.

In the present invention, the method of deposition of the aluminium oxide film is not limited. In an embodiment, the aluminium oxide layer may be deposited by vacuum deposition.

A person skilled in the art may adjust the thickness of the barrier layer appropriately, for example, depending on the intended shelf life, the packaged product and the overall thickness of the packaging material. In the multi-layer flexible packaging material in accordance with present invention, the barrier layer may have a thickness in the range of 20-500 nm, 30-400 nm, or 50-200 nm, for example.

The range of optical density for the barrier layer may preferably be in the range of 1.4-3.8, which correlates with a thickness of 30-200 nanometres.

A nanoclay barrier coating layer is known to people skilled in the art. For example. The nanoclay barrier coating layer may be a PVOH-polyacrylic acid-nanoclay barrier coating layer. Examples of such PVOH-polyacrylic acid-nanoclay barriers are commercially available from specialist suppliers. Also, a person skilled in the art will be able to formulate such PVOH-polyacrylic acid-nanoclay barriers. Sustainable barrier Coatings in Paper and Board to 2023, a state of the art report, Smithers information Ltd. 2018, pages 134-142, summarizes the state of the art. Typically, such PVOH-polyacrylic acid-nanoclay barriers can be manufactured, e.g., by functionalizing the surface of the nanoclay to allow sufficient repulsive forces to allow for the formation of the tortuous path. The nanoclays may be selected from the group consisting of aluminosilicates, such as montmorillonite (MMT) nanoclays, for example.

For some applications it may be preferred if the nanoclay barrier coating layer has a composition comprising polyurethane. Polyurethane may be used to partially or completely replace the PVOH-polyacrylic matrix. Polyurethane has the advantage of imparting very good chemical resistance, solvent resistance and durability, for example. As such, the nanoclay barrier coating layer composition may comprise between 1-10 weight-% polyurethane, between 2-6 weight-% polyurethane, or between 3-5 weight-% polyurethane, for example.

For some applications it may be preferred, if the nanoclay is dispersed in a polyvinylidene dichloride polymer matrix. In this case intrinsic hydrophobicity and steric hinderance effects in PVDC matrix further improve the WVTR barrier properties.

In a preferred embodiment, the nanoclay is dispersed in a matrix of butenediol-vinyl alcohol copolymer (BVOH), polybutylene succinate (PBS), copolymers of polybutylene succinate, polyhydroxyalkanoate (PHA), polylactic acid (PLA) and mixtures thereof.

In the above-embodiments, the nanoclay material is present in the polymeric layer in an amount between 0.5 and 10.0 weight-%, between 1.0 and 8.0 weight-%, or between 1.25 and 5.0 weight-% of the polymeric layer.

In an embodiment, the remainder of the polymeric layer is butenediol-vinyl alcohol copolymer (BVOH), polybutylene succinate (PBS), copolymers of polybutylene succinate, polyhydroxyalkanoate (PHA), polylactic acid (PLA) and mixtures thereof.

In a preferred embodiment, the polymeric layer comprises a portion comprising a nanoclay dispersed in a matrix of butenediol-vinyl alcohol copolymer (BVOH), polybutylene succinate (PBS), copolymers of polybutylene succinate, polyhydroxyalkanoate (PHA), polylactic acid (PLA) and mixtures thereof and a second portion comprising butenediol-vinyl alcohol copolymer (BVOH), polybutylene succinate (PBS), copolymers of polybutylene succinate, polyhydroxyalkanoate (PHA), polylactic acid (PLA) and mixtures thereof.

In a preferred embodiment, the weight ratio between the nanoclay containing portion and the second portion is between 0.1:1.0 and 1.0:0.1, preferably between 0.25:1.0 and 1.0:0.25 and more preferably between 0.5:1.0 and 1.0:0.5. For example, 1.0:1.0.

In a highly preferred embodiment, the polymeric layer comprises a first portion of a mixture of a nanoclay dispersed in a matrix of butenediol-vinyl alcohol copolymer (BVOH) and a second portion of BVOH.

In a preferred embodiment, the polymeric layer comprises a BVOH and nanoclay mixture and the second portion of BVOH is a layer.

In a preferred embodiment, the ratio of the first portion to the second portion is between 0.25:1.0 and 1.0:0.25. In a preferred embodiment, the polymeric layer has a grammage in the range of from 1 to 20 g/m2 (i.e. total grammage, for both portions).

In the present invention, the embodiments utilizing BVOH in the polymeric layer were found to be the most preferred from the viewpoint of barrier properties.

The nature of the sealant is not particularly limited, however, in a preferred embodiment, the sealant comprises a material selected from polyesters (e.g. PHA, PBS, PBSA, etc.), cellophane, polyvinyl alcohols and derivatives (e.g. BVOH, PVOH etc.) and mixtures thereof.

In a preferred embodiment, the sealant layer comprises at least one material selected from polyhydroxyalkanoate (PHA), polybutylene succinate (PBS), copolymers of polybutylene succinate and mixtures thereof.

In the present invention, where the term "copolymers of polybutylene succinate" is used this covers known copolymers in the art used in packaging, most preferably poly (butylene succinate-coadipate) (PBSA).

In a preferred embodiment, the paper layer has a grammage of from 40 to 130 g/m2, preferably from 50 to 100 g/m2 and more preferably or 60 to 100 g/m2 or 55 to 90 g/m2.

In a preferred embodiment, the polymeric layer has a grammage in the range of from 1 to 20 g/m2, preferably from 2 to 15 g/m2 and more preferably from 3 to 10 g/m2.

In a preferred embodiment, the sealant layer has a grammage in the range of from 1 to 30 g/m2, preferably from 2 to 25 g/m2 and more preferably from 5 to 15 g/m2.

In a preferred embodiment, the total grammage of the packaging is in the range of from 42.5 to 150 g/m2, preferably from 50 to 125 g/m2, and more preferably from 60 to 100 g/m2.

In a preferred embodiment, the paper layer has a grammage of from 60 to 100 g/m2, the polymeric layer has a grammage in the range of from 3 to 10 g/m2, the barrier layer comprises a metallized material, and the sealant layer has a grammage in the range of from 5 to 15 g/m2.

The multi-layer flexible packaging material of the present invention may be a packaging material for a food product. It may be a primary packaging material, a secondary packaging material or a tertiary packaging material, for example. If the multi-layer flexible packaging material is a packaging material for a food product, a primary packaging material for a food product may be a packaging material for a food product that is in direct contact with the actual food product. A secondary packaging material for a food product may be a packaging material for a food product that helps secure one or more food products contained in a primary packaging. Secondary packaging material is typically used when multiple food products are provided to consumers in a single container. A tertiary packaging material for a food product may be a packaging material for a food product that helps secure one or more food products contained in a primary packaging and/or in a primary and secondary packaging during transport.

In a preferred embodiment, the packaging is a primary packaging for a food product, preferably a confectionery food product, preferably a chocolate product and/or biscuit or wafer product.

For some applications of the present invention it may be preferred if the paper layer was non-porous. If the paper layer has a porous surface, an additional surface layer covering the porous paper surface may be added to make it air impermeable. Such an additional surface layer can comprise or consist of starch, pigment-starch or a pigment-latex formulation. The ratio of pore volume to total volume of the paper material is called the porosity of the paper material. For the purpose of the present invention, a paper layer shall be considered as non-porous if a Gurley permeability is less than 20 ml/min (Tappi T547), if it has a porosity of less than 40%, for example, less than 30% or less than 20%. Hence, in one embodiment of the present invention, the paper layer is a non-porous paper layer.

It may also be preferred, if the paper layer had a low surface roughness. For example, the paper layer may have a Bendtsen roughness of less than 100 ml/min. The Bendtsen roughness can be determined in accordance with ISO 8791-2:2013, herewith incorporated herein by reference.

Barrier properties of packaging materials are well known to the person skilled in the art. If the packaging material is a packaging material for a food product, for example, such good barrier properties are essential for maintaining the safety and quality of packaged foods. Typically, such barrier properties include gas permeability, for example O2, CO2, and N2; vapor permeability, for example water vapor; liquid permeability, for example water or oil; aroma permeability; and light permeability.

Before the aluminium layer and/or the nanoclay barrier are applied to the paper layer, primers may be used to better connect the coating with the paper layer. Primers typically have a chemical nature that allows that the coating adheres strongly to them, while the primer—in turn—adheres strongly to the paper layer.

Primers for the purpose of the present invention may be selected from the group consisting of acrylic acid copolymers, polyesters, polyhydroxyalkanoates, native and chemically modified starches, xylan and chemically modified xylan, polyvinylidene dichloride, polyvinyl alcohol, ethyl-vinyl alcohol, vinyl acetate, ethyl-vinyl acetates, cellulose nitrate, polyolefines, silanes, polyurethanes, or combinations thereof.

One or more primers used for the purposes of the present invention may comprise nanoclay. Adding nanoclay to at least one primer has the advantage that the barrier properties of the resulting multi-layer flexible packaging material are improved. Hence, in the multi-layer flexible packaging material in accordance with the present invention, for example, the primer applied to the inner surface of the paper layer may comprise nanoclay. This results in enhanced barrier properties.

Appropriate primers are known to the person skilled in the art and can be selected accordingly. The primer to be applied between paper layer and aluminium layer may be polyurethane, for example. Alternatively, a polyurethane tie layer may be used. The primer to be applied between paper layer and nanoclay barrier coating layer may also be polyurethane.

To ensure that the aluminium layer is well protected against abrasion, for example, it may be protected with a protection layer. Appropriate protection layers are well-known to the person skilled in the art and may be selected from the group consisting of acrylic acid copolymers, polyesters, polyhydroxyalkanoates, native and chemically modified starches, xylan and chemically modified xylan, polyvinylidene dichloride, polyvinyl alcohol, ethyl-vinyl alcohol, vinyl acetate, ethyl-vinyl acetates, cellulose nitrate, polyolefines, silanes, polyurethanes, or combinations thereof. Using such protection layers has the advantage that the aluminium layer is stabilized and well protected against unfavourable influences, maintaining its integrity and—hence—its positive influence on the barrier properties of the multi-layer flexible packaging material of the present invention.

The multi-layer flexible packaging material in accordance with the present invention comprises a sealing layer.

Coating paper materials, such as paper packaging materials, with a sealing layer, for example, with polymer dispersions, e.g., to improve the barrier properties of the paper material, is well known in the art. Examples are, for example described in Kimpimäki T., Savolainen A. V. (1997) Barrier dispersion coating of paper and board. In: Brander J., Thorn I. (eds) Surface Application of Paper Chemicals. Springer, Dordrecht. coated, paper materials.

For consumer information and design purposes an ink layer may be applied onto the paper layer. Also here it may be preferred, if there is a primer applied between paper layer and ink layer. Appropriate primers are known to the person skilled in the art, and may, for example, be a polyurethane primer.

In order to add a high quality finishing to the outer surface of the multi-layer flexible packaging material in accordance with the present invention an overprint varnish (OPV) may be applied to the surface of the ink layer. OPV are well-known to the person skilled in the art and may be chosen, e.g., according to the intended purpose of the packaging material of the present invention. For example, the OPV may be selected from the group consisting of conventional offset letterpress varnishes, acrylic varnishes, UV varnishes, and gravure varnishes which can be represented by water or solvent-based polymer formulations.

Thus, the multi-layer flexible packaging material of the present invention may further comprise a primer applied to the paper layer, an ink layer applied to the primer on the paper layer, and an overprint varnish layer applied to the ink layer.

As discussed above, the inventors were surprised to see that comparable satisfying barrier properties were achieved when aluminium layer and PVOH-polyacrylic acid-nanoclay barrier coating layer were both located on the inner side of the packaging material facing the packaged product. This allows it that only the ink layer, optionally together with primer and/or OVP is on the outer surface of the packaging material. Consequently, aluminium layer and PVOH-polyacrylic acid-nanoclay barrier coating layer are well protected from any external influence, for example, during shipping, handling and consumer contact, so that their integrity is well protected and the barrier properties of the multi-layer flexible packaging material of the present invention are easier to maintain.

The multi-layer flexible packaging material in accordance with the present invention may have any thickness suitable for packaging materials. A person skilled in the art will be able to determine an appropriate thickness. Typically, however, in particular if the packaging material is intended for use in packaging food products, the packaging material should be as thin as possible, while still ensuring safety and shelf life of the food product. For example, the multi-layer flexible packaging material in accordance with the present invention may have an overall thickness in the range of 30-150 μm, 40-120 μm, or 50-100 μm.

A person skilled in the art may select the grammages or thicknesses of the individual components of the multi-layer flexible packaging material in accordance with the present invention appropriately.

In a preferred embodiment of the present invention, the multi-layer flexible packaging material in accordance with the present invention may be recyclable. For example, it may be recyclable with the paper and carton stream. During recycling, the aluminium layer will be separated from the rest of the packaging. The fact that the subject matter of the present invention achieves it to omit a polyolefin layer, such as a PE or a PP layer, improves the sortability of the packaging material of the present invention during recycling. Typically, aluminium is separated from the rest of the packaging material during recycling in a hydra-pulper. Hence, the multi-layer flexible packaging material in accordance with the present invention may be recyclable as paper and/or carton.

One advantage of the subject matter of the present invention is it that despite preferably omitting a polyolefin layer, such as a PE or a PP layer, excellent barrier properties are achieved.

The multi-layer flexible packaging material in accordance with the present invention may have a WVTR barrier in the range of 0.1-50 g/m2d (38° C., 90% RH).

These excellent barrier properties allow it that the multi-layer flexible packaging material in accordance with the present invention may be used to package food products. For the purpose of the present invention, the term "food" shall mean in accordance with Codex Alimentarius any substance, whether processed, semi-processed or raw, which is intended for human consumption, and includes drink, chewing gum and any substance which has been used in the manufacture, preparation or treatment of "food" but does not include cosmetics or tobacco or substances used only as drugs.

Remarkably, the excellent barrier properties allow it that the multi-layer flexible packaging material in accordance with the present invention may be used to package dry food products. Dry food products include powders and granulates, for example powders and granulates to be reconstituted in milk or in water. Dry food products may have a water content of 5% or less, for example.

Hence, the multi-layer flexible packaging material in accordance with the present invention may be to be used to package dry food. The subject matter of the present invention also extends to the use of a multi-layer flexible packaging material in accordance with the present invention to package dry food.

Those skilled in the art will understand that they can freely combine all features of the present invention disclosed herein. In particular, features described for the product of the present invention may be combined with features described for the process of the present invention and vice versa. Further, features described for different embodiments of the present invention may be combined.

Although the invention has been described by way of example, it should be appreciated that variations and modifications may be made without departing from the scope of the invention as defined in the claims.

Furthermore, where known equivalents exist to specific features, such equivalents are incorporated as if specifically referred in this specification. Further advantages and features of the present invention are apparent from the figures and non-limiting examples.

EXAMPLES

Examples 1-4

The following compositions were prepared using metallisation (vacuum deposition—aluminium), dispersion coating for the polymeric layer and extrusion coating for the sealant layer.

| Example | Paper/ gsm | Coating weight | Sealing weight/gsm | Total Weight/gsm |
|---|---|---|---|---|
| 1 | 62 | 3 gsm BVOH + Nanoclay (5% within the 3 gsm BVOH), 2 gsm BVOH | 10 gsm PBSA | 77 |
| 2 | 62 | 4 gsm PBSA, 3 gsm PHA | 10 gsm PBSA | 77 |
| 3 | 75 | 3 gsm BVOH + Clay Nanoclay (5% within the 3 gsm BVOH), 3 gsm BVOH | 10 gsm PBSA | 92 |
| 4 | 75 | 4 gsm PBSA, 3 gsm PHA | 10 gsm PBSA | 92 |

Example 5

The following compositions of the present invention were prepared for marine degradation tests:

2020-31: OPV/ink/paper/PHA/metallised/PVOH 2020-32: OPV/ink/paper/BVOH/metallised/PVOH 2020-33: OPV/ink/paper/PHA/AlOx/PVOH The disintegration test is performed in duplicate. At start-up 2 pieces of 2 cm×2 cm were added per reactor. Every 4 weeks the contents of the reactors are sieved over a 2.0 mm screen and the disintegration of the reference material and test materials is visually monitored.

Figure 2:
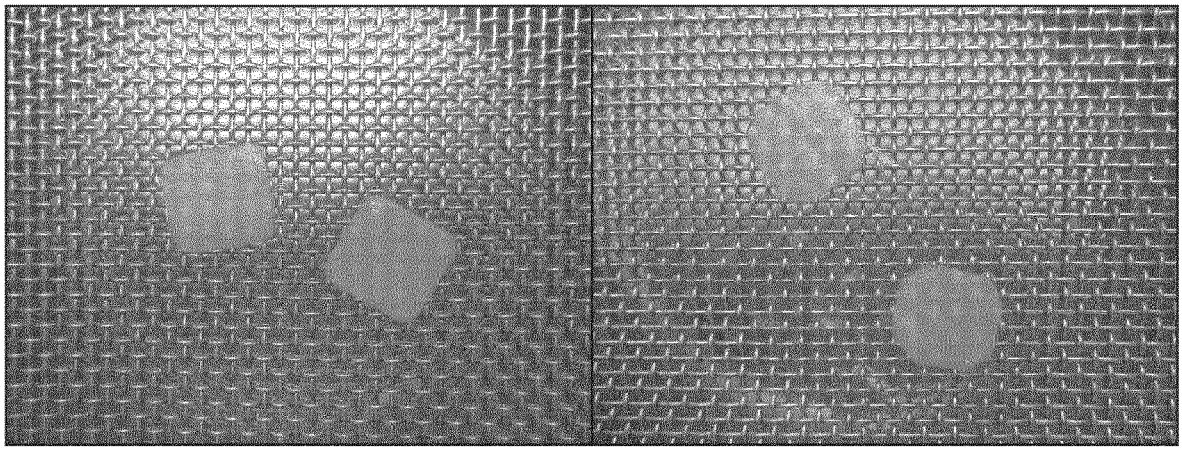
FIG. 2. Visual presentation of reference item cellulose filter paper after 8 weeks of incubation FIG. 3. Visual presentation of test item 2020-31 after 8 weeks of incubation FIG. 4. Visual presentation of test item 2020-32 after 8 weeks of incubation FIG. 5. Visual presentation of test item 2020-33 after 8 weeks of incubation FIG. 6. Schematic of Examples 1-4

FIG. 1 gives a visual presentation of reference material and test items at the start-up. FIGS. 2 up to 5 give a visual presentation of the retrieved pieces in the replicates of reference and test items after 8 weeks of incubation at 30° C.±2° C.

After 8 weeks of incubation the disintegration of reference item cellulose filter paper has not progressed much except for some degradation on the edges (FIG. 2).

Figure 3:
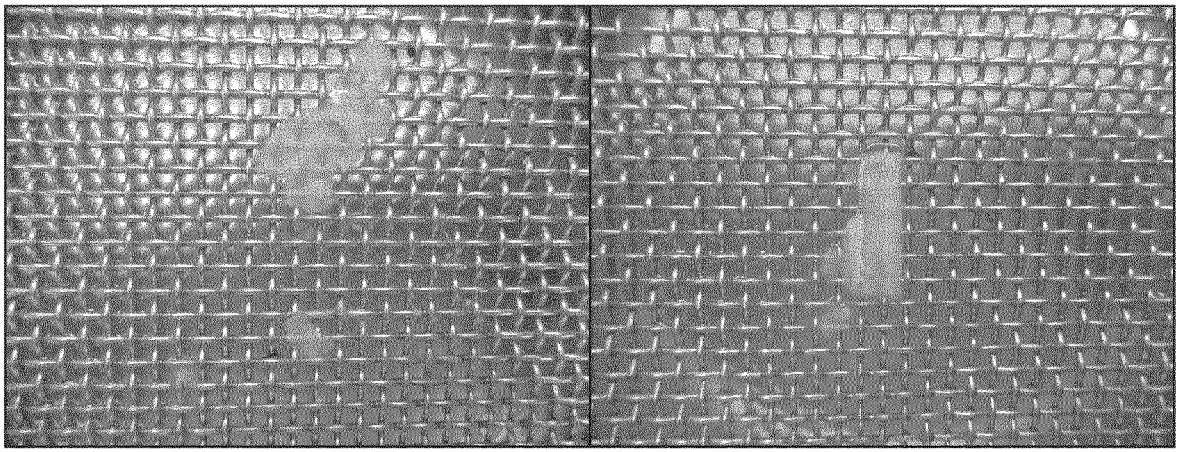

The disintegration of test item 2020-31 evolved significantly leaving only a few parts on the 2.0 mm sieve and only a fraction of the top layer was still visible (FIG. 3).

Figure 4:
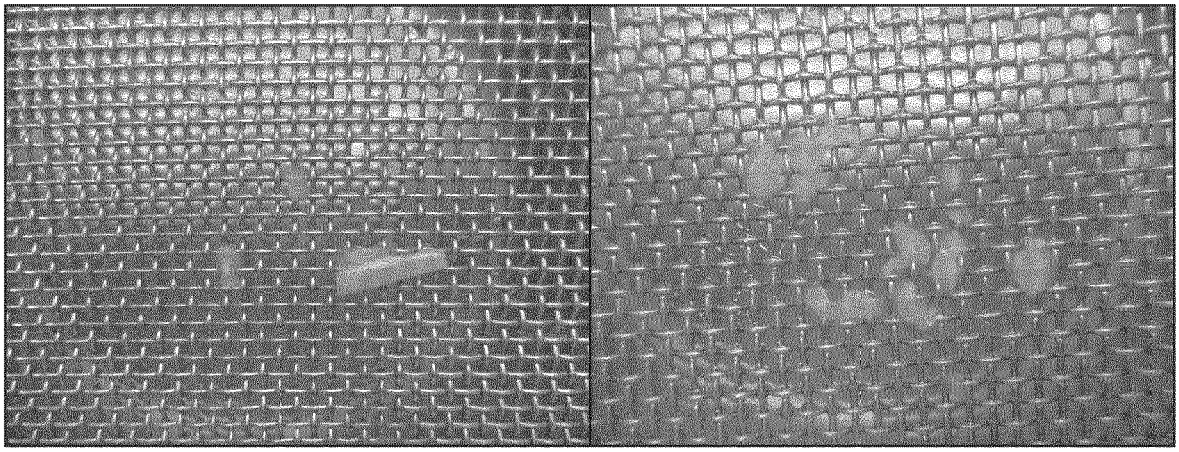

Test item 2020-32 continued to degrade and the majority of the fragments already passed the 2.0 mm sieve (FIG. 4).

Figure 5:
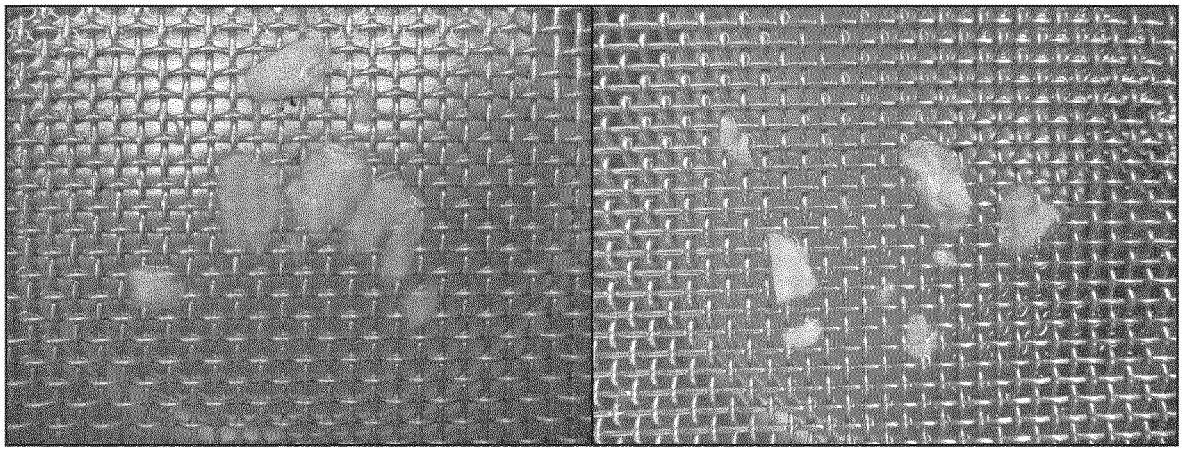
Figure 6:
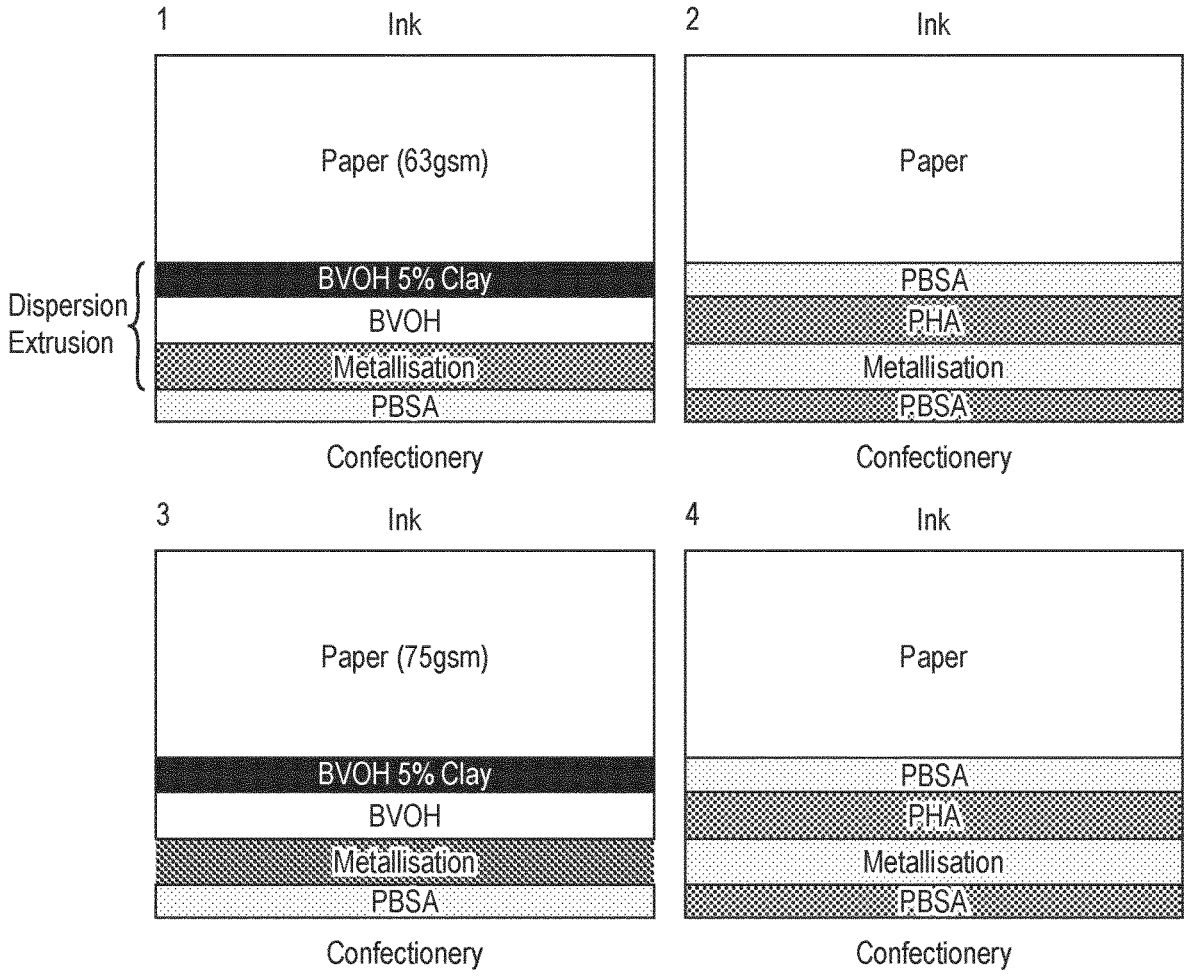

The indentations after 4 weeks in test item 2020-33 have continued and general fragmentation was visible (FIG. 5).

Example 6

WVTR at g/m$^2$/day 85% RH at 23 degrees C. for Examples 1 and 3 were compared against an 81 gsm commercially available one side coated, glossy paper with a barrier (oxygen, water vapor, grease, mineral oil and aroma) coating on reverse side.

| Sample | Folded | Flat |
|---|---|---|
| Example 1 | 5.1 ± 0.4 | 2.1 |
| Example 3 | 4.0 ± 0.2 | 0.7 |
| Reference | 20.7 ± 3.9 | 0.16 ± 0.03 |

Example 7

Single finger standard KitKat® (a chocolate encased-wafer product) were packaged using rates of 30 and 80 bars per minute using paper from Example 3 on an automated packaging line. The bars were packaged without any issues, there were no observations of quality defects. The packaging was sealed at 200N for 0.5 seconds between 100-110 degrees.

EXOS tests using the Abiss Leak system were run on six sample bars. The standard is less than 16 ml/min. The samples provided a range of from 3.2-4.2 ml/min at an average of 3.6 ml/min.

Grease testing using a food-safe lubricant applied to the interior of the paper provided no observation of grease penetration/barrier break following grease testing.

Example 8

Example 7 was repeated for the papers of Example 1. Ran at 30 and 80 bars per minute with no observations of quality defects. EXOS values of 2.0 and 3.1 were obtained on two tests and no observation of grease penetration/barrier break following grease testing.

Example 9

Additional grease resistance tests were carried out with 2 cycles times of 25° C./50% RH for 6 hours and 40° C./50% RH for 6 hours on Examples 1-4 wrapping a KitKat® four finger product. All examples provided results that indicate at least a shelf life of 6 months, with Examples 1, 3 and 4 providing 0.3% or under area grease staining. Example 3 provided 0.0% area in two separate trials.

Examples 10-13

The following compositions were prepared using metallisation (vacuum deposition—aluminium), dispersion coating for the polymeric layer and extrusion coating for the sealant layer.

| Example | Paper/ gsm | Coating weight | Sealing weight/gsm | Total Weight/gsm |
|---|---|---|---|---|
| 10 | 62 | 3 gsm BVOH + Nanoclay (5% within the 3 gsm BVOH), 2 gsm BVOH | 11.5 PBS | 77 |
| 11 | 62 | 4 gsm PBSA, 3 gsm PHA | 12.5 PBS | 77 |
| 12 | 75 | 3 gsm BVOH + Clay Nanoclay (5% within the 3 gsm BVOH), 3 gsm BVOH | 11.5 PBS | 77 |
| 13 | 75 | 4 gsm PBSA, 3 gsm PHA | 10.2 PBS | 92 |

The materials were coated with a 10 nm gold layer and assessed using microscopy at a factor of 100× and 1000×.

The materials were assessed for holes and were found to be pinhole-free after coating. Examples 10 and 12 were found to have a more homogeneous coating with a lower level of particulates visible. This supports the finding that the BVOH coating provides the most effective barrier properties within the present invention.

Recyclability was assessed by ProPakma GmBH using fibre yield and found to have acceptable recyclability levels.

The relative WVTR at 90% RH, 38 degrees C. and at 65% RH, 22 degrees C. were assessed and Examples 10 and 12 were found to be superior to Examples 11 and 14.

The invention claimed is:

1. A multi-layer flexible packaging material comprising the following layers from an outer surface to an inner surface:

a paper layer, a polymeric layer comprising butenediol-vinyl alcohol copolymer (BVOH) and clay, a barrier layer comprising a component selected from the group consisting of a metallized material, aluminium oxide, silicon oxide and mixtures thereof, and a sealant layer.

2. A multi-layer flexible packaging material in accordance with claim 1, wherein an ink is applied to the outer surface of the paper layer.

3. A multi-layer flexible packaging material in accordance with claim 1, wherein the polymeric layer comprises a mixture of polybutylene succinate (PBS) or copolymers of polybutylene succinate with a polyhydroxyalkanoate.

4. A multi-layer flexible packaging material in accordance with claim 1, wherein the paper layer has a grammage of from 40 to 130 g/m2.

5. A multi-layer flexible packaging material in accordance with claim 1, wherein the polymeric layer has a grammage in the range of from 1 to 20 g/m2.

6. A multi-layer flexible packaging material in accordance with claim 1, wherein the sealant layer has a grammage in the range of from 1 to 30 g/m2.

7. A multi-layer flexible packaging material in accordance with claim 1, wherein a total grammage of the packaging is in the range of from 42.5 to 150 g/m2.

8. A multi-layer flexible packaging material in accordance with claim 1, wherein the barrier layer has a thickness in the range of from 20 to 500 nm.

9. A multi-layer flexible packaging material in accordance with claim 1, wherein the packaging material has an overall thickness in the range of from 30 to 150 μm.

10. A multi-layer flexible packaging material in accordance with claim 1, wherein:

the paper layer has a grammage of from 60 to 100 g/m2, the polymeric layer has a grammage in the range of from 3 to 10 g/m2, the barrier layer comprises a metallized material, and the sealant layer has a grammage in the range of from 5 to 15 g/m2.

11. A multi-layer flexible packaging material in accordance with claim 1, wherein the material comprises an aluminium metallized layer and the polymeric layer comprises a BVOH and nanoclay mixture and also comprises a BVOH layer.

12. A dry food product packaged in a multi-layer flexible packaging material comprising the following layers from an outer surface to an inner surface:

a paper layer, a polymeric layer comprising butanediol-vinyl alcohol copolymer (BVOH) and clay, a barrier layer comprising a component selected from the group consisting of a metallized material, aluminium oxide, silicon oxide and mixtures thereof, and a sealant layer.

13. The packaged dry food product of claim 12, wherein the dry food product is a confectionery product.

14. A multi-layer flexible packaging material in accordance with claim 1, wherein the polymeric layer further comprises at least one polymer selected from the group consisting of polybutylene succinate (PBS), copolymers of polybutylene succinate, polyhydroxyalkanoate (PHA), polylactic acid (PLA) and mixtures thereof.

* * * * *